US011305922B2

(12) United States Patent
Ornduff et al.

(10) Patent No.: US 11,305,922 B2
(45) Date of Patent: Apr. 19, 2022

(54) CHILD SAFE CLOSURE FOR A CONTAINER

(71) Applicant: Peter Barsoom, Denver, CO (US)

(72) Inventors: Brian Ornduff, Brooklyn, NY (US); Joe D. Doucet, Brooklyn, NY (US); Karl Fredrick Biewald, Minneapolis, MN (US)

(73) Assignee: Peter Barsoom, Denver, CO (US)

( * ) Notice: Subject to any disclaimer, the term of this patent is extended or adjusted under 35 U.S.C. 154(b) by 104 days.

(21) Appl. No.: 16/663,468

(22) Filed: Oct. 25, 2019

(65) Prior Publication Data

US 2020/0130903 A1 Apr. 30, 2020

Related U.S. Application Data

(60) Provisional application No. 62/751,806, filed on Oct. 29, 2018.

(51) Int. Cl.
*B65D 51/00* (2006.01)
*B65D 51/24* (2006.01)

(52) U.S. Cl.
CPC ..... *B65D 51/007* (2013.01); *B65D 51/245* (2013.01); *B65D 2215/00* (2013.01)

(58) Field of Classification Search
CPC ..... B65D 51/007; B65D 51/245; B65D 2215/00; B65D 51/00; B65D 51/02; B65D 51/04; B65D 51/14; B65D 51/18; B65D 2215/02; B65D 2215/04
USPC ..... 220/254.3; 215/216, 237
See application file for complete search history.

(56) References Cited

U.S. PATENT DOCUMENTS

| | | | | |
|---|---|---|---|---|
| 5,765,705 | A * | 6/1998 | Deubel | B65D 50/045 215/216 |
| 6,290,084 | B1 | 9/2001 | Louie | |
| 7,823,736 | B1 * | 11/2010 | Pugne | B65D 55/16 215/235 |
| 2005/0133475 | A1 | 6/2005 | Goto et al. | |
| 2007/0144996 | A1 | 6/2007 | Sawyer | |
| 2012/0267336 | A1 | 10/2012 | Faragher et al. | |

* cited by examiner

*Primary Examiner* — Steven A. Reynolds
*Assistant Examiner* — Javier A Pagan
(74) *Attorney, Agent, or Firm* — Thompson Coburn LLP

(57) ABSTRACT

A closure for a container has a base and a lid. The base is attachable to the container. The lid is pivotally connected to the base and moveable between open and closed positions. The lid or the base has operating tabs on its periphery. Each operating tab has an actuation portion and an engagement portion. The engagement portion is moveable between engagement and disengagement positions. When the lid is in the closed positioned, the engagement portion engages the other of the lid and the base in the engagement position and disengages from the other of the lid and the base in the disengagement position. The actuation portion of the operating tab is resiliently deflectable radially outward relative to the one of the lid and the base to move the engagement portion to the disengagement position whereupon release of the actuation portion, the engagement portion returns to the engagement position.

19 Claims, 13 Drawing Sheets

CHILD SAFE CLOSURE FOR A CONTAINER

CROSS-REFERENCE TO RELATED APPLICATIONS

This application claims the benefit of U.S. provisional patent application No. 62/751,806, filed Oct. 29, 2018.

SUMMARY

The following disclosure relates to a child safe closure for a container. More in particular, the disclosure relates to a child safe closure that may be attached to a container having a raised outer edge. In one example, the child safe closure may be attached to a beverage can, for instance, a slim (200 end diameter) can, a sleek or standard (202 end diameter) can, or a king (206/209/300 end diameter) can.

DETAILED DESCRIPTION

Figure 1:
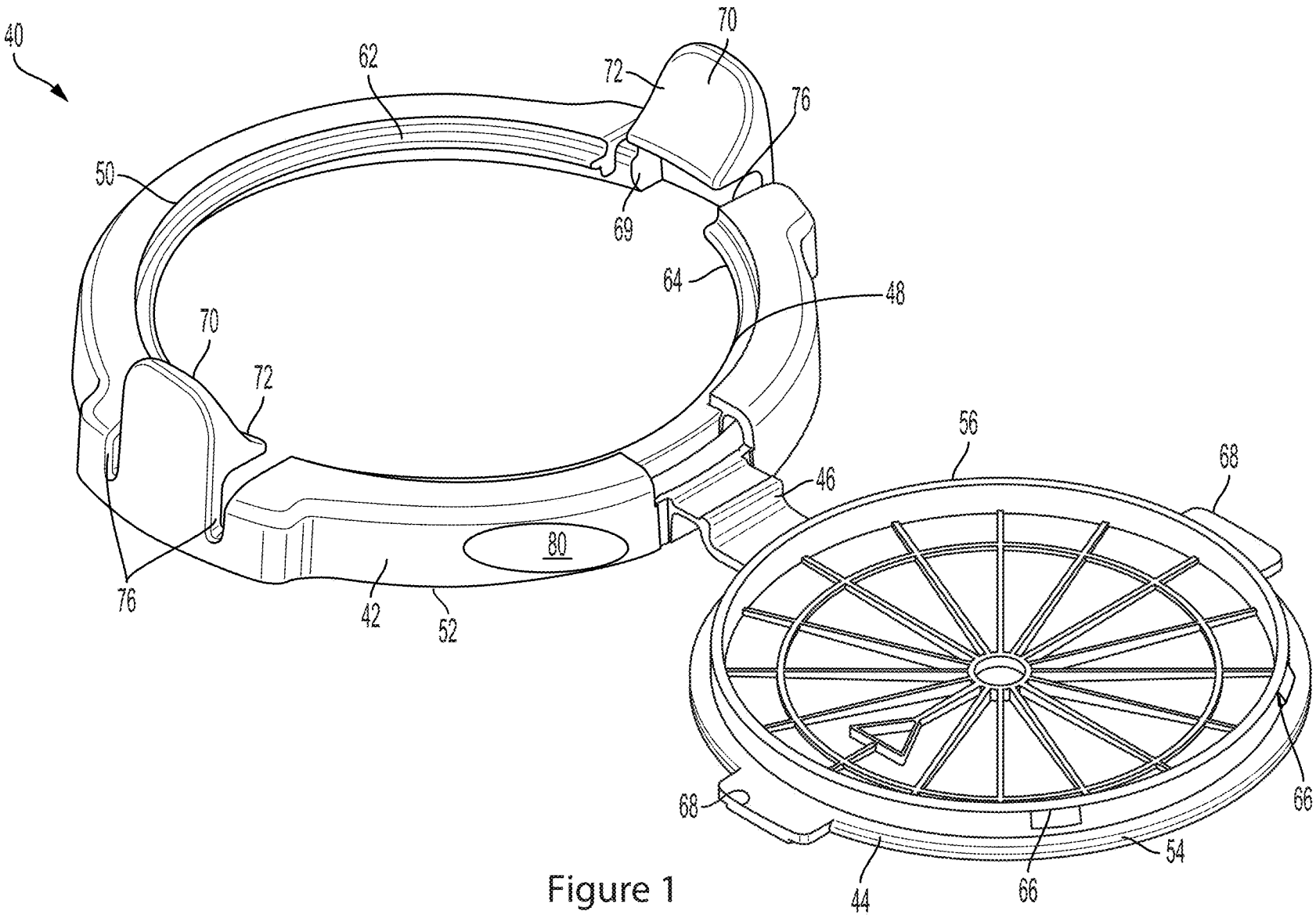
FIG. 1 is a perspective view of an exemplary child safe closure with a lid portion of the closure opened relative to base portion of the closure.

The child safe closure 40 comprises a base portion 42 and a lid portion 44 connected thereto. The lid portion 44 may be connected to the base portion 42 with a hinge 46 and may be pivotable relative the base portion via the hinge between an open position in which an opening 48 in the base portion is exposed thereby providing the user with access to the container through the opening in the base, and a closed position in which the lid portion is releasably engaged with the base portion and covers the opening in the base portion, thereby preventing access to the container through the opening in the base. In addition to and/or alternative, in the open position of the lid portion 44 relative to the base portion 42, the closure 40 may be deflected/deformed as necessary to allow the base portion to be removed from the container. The base portion 42 may have a top 50 and a bottom 52 with the bottom being configured to engage the container, and the top being configured to releasably engage the lid portion in the closed position of the closure. The base portion 42 may be press fit on the container, and with the lid portion 44 in the open position, the base portion 42 may be deflected/deformed/broken to remove the base portion from the container when free access to the container is needed. The lid may have a top 54 and bottom 56. The lid bottom may generally abut the base when the lid portion is engaged with the base portion, and the top may be exposed to view when the lid portion is engaged with the base portion. The base portion 42 may be made of a resilient material, for instance, a resilient plastic that may deform slightly to allow the base portion to attach to a container, and to allow the base portion to releasably engage with the lid portion. The material of the base portion 42 may be sufficient to allow the base portion to be deflected/deformed/broken to release the base portion from the container. The lid portion 44 may also be made from a resilient material, for instance, a resilient plastic that may deform slightly to allow the lid portion to releasably engage with the base portion. The lid portion and the base portion may be separate member and integrally connected via the hinge. The lid portion 44 and the base portion 42 may be of a monolithic, one piece construction with the hinge 46 being a live hinge. While the drawing to show a circular shaped base portion and a circular shaped lid portion, the base and lid portion may be different or the same shape, and may be any shape. By way of example and not in any limiting sense, the base portion may have the same shape as the outer raised edge of a container, and may be circular, rectangular, square, or oval, and may be dimensioned as needed to releasably attach to a container. As shown in the drawings, by way of example, the base portion may have an internal groove 60 that is dimensioned and shaped to receive the raised edge, for instance, the crimped raised edge, of a beverage container or a similar type container having a raised edge, such as a tin or a container simulating a tin. The groove 60 may be dimensioned for a tight press fit with the raised rim of the container or an interference fit whereby, for instance, the groove may expand to receive the raised rim of the container. The groove 60 may be deformed after installation on the container thereby rendering the closure a single use type of closure.

The base portion opening 48 may extend from the top 50 to the bottom 52 and provide access to the container when the lid portion 44 is moved to the open position. The base portion top may have a recess 62 around the opening 48 with a rim 64 extending from the recess and projecting into the opening. The rim 64 and recess 62 may be continuous around the base portion top or each may comprise surfaces intermittently spaced about the top. When the lid 44 portion is pivoted to the closed position relative to the base portion 42, the lid portion is placed in register with and received in the recess 62 of the top 50 and may rest upon the rim 64. The lid portion 44 may have radially extending protrusions 66 intermittently spaced about the lid to assist in locating the lid portion in the recess. The radial protrusions 66 may rest on the rim and/or engage the recess. The radially extending protrusions 66 intermittently spaced about the lid periphery may assist in enabling the lid to be pivoted out of the recess to the opening position without binding the lid in the recess. The lid portion 44 may have lobes 68 the extend outward and cooperate with cut-outs 69 formed in the base portion 42 in securing the lid portion to the base portion. When the lid portion 44 is pivoted to the open position, the lid portion 44 is pivoted out of register with the recess 62 and the lobes 68 of the lid portion are moved out of register with the cut-outs in the base portion 42 to uncover the opening in the base portion thereby providing access to the container, and if desired, removal of the base portion from the container via deflection/deformation/breakage.

Figure 2:
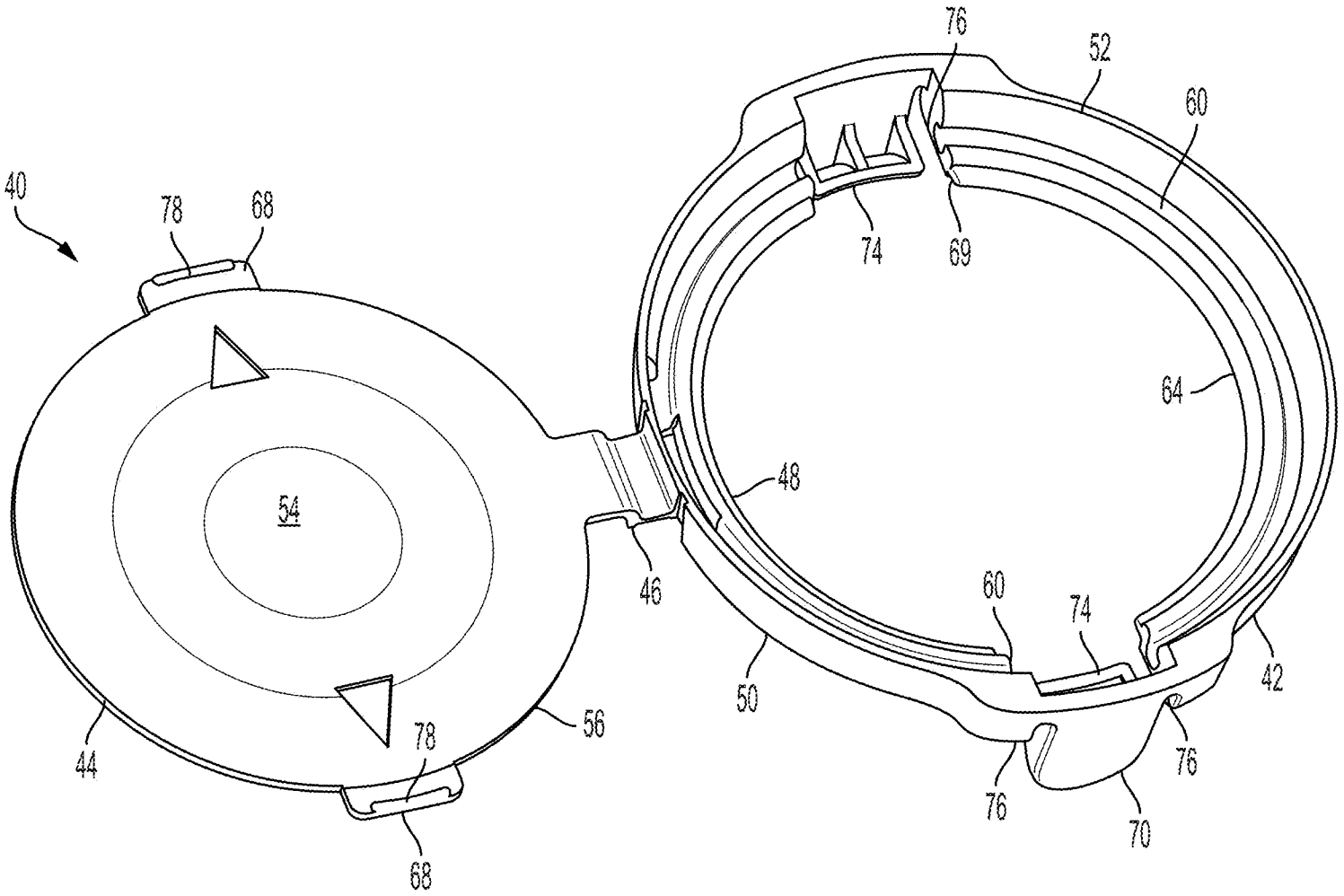
FIG. 2 is an alternate perspective view of the closure of FIG. 1.
Figure 3:
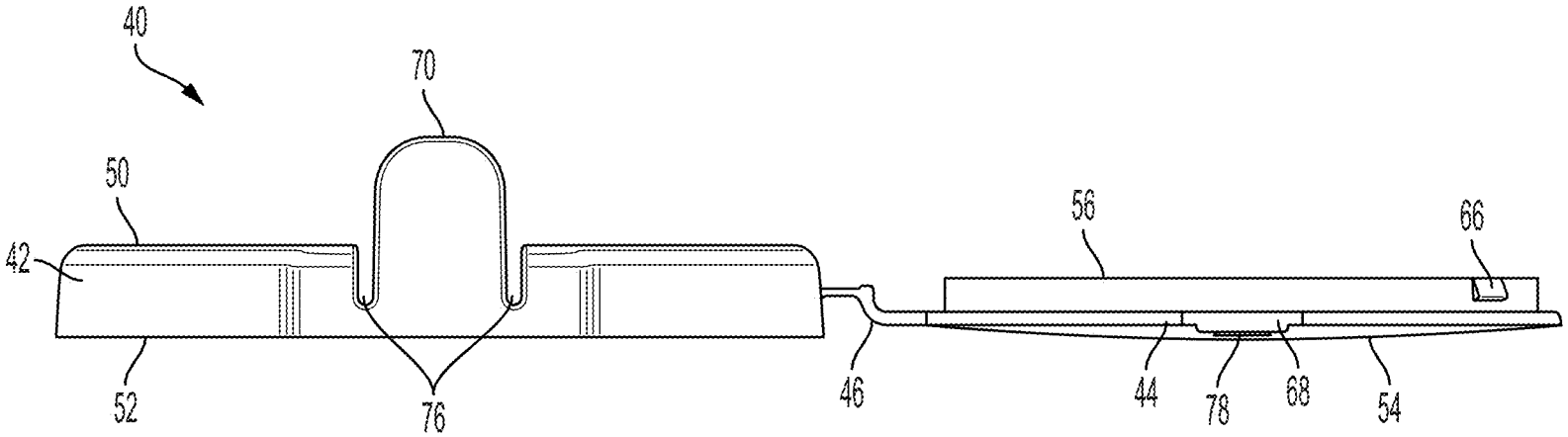
FIG. 3 is a front view of the closure of FIG. 1.
Figure 4:
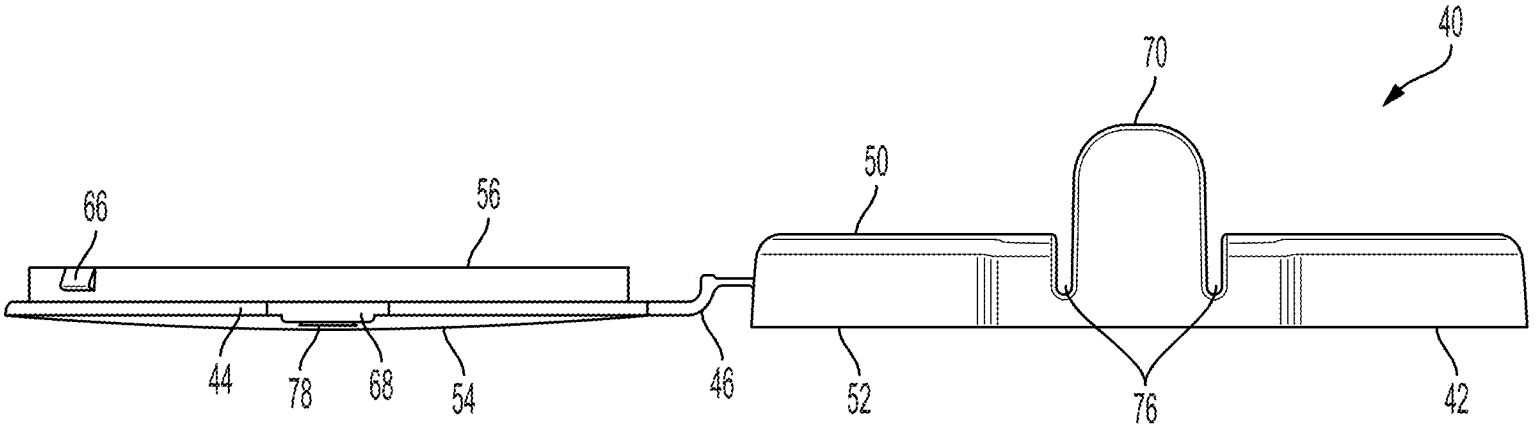
FIG. 4 is a rear view of the closure of FIG. 1.
Figure 5:
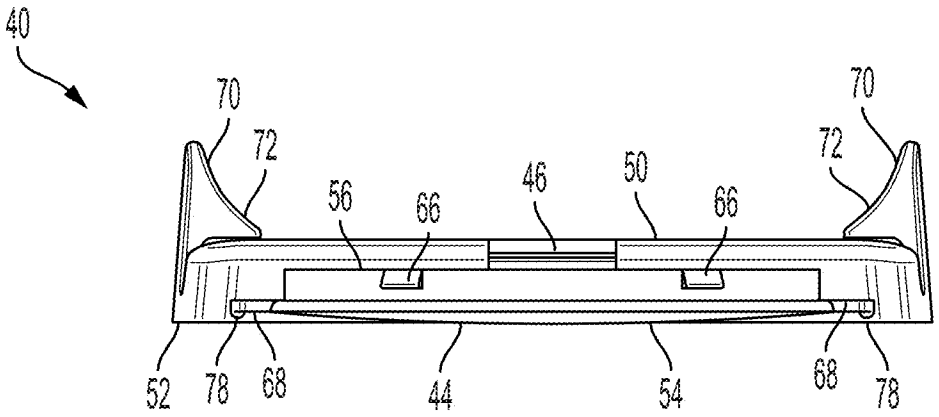
FIG. 5 is a right side view of the closure of FIG. 1.
Figure 6:
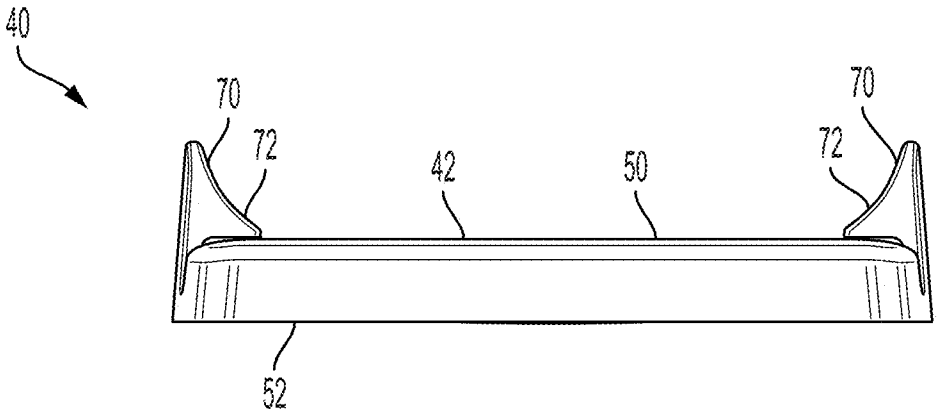
FIG. 6 is a left side view of the closure of FIG. 1.
Figure 7:
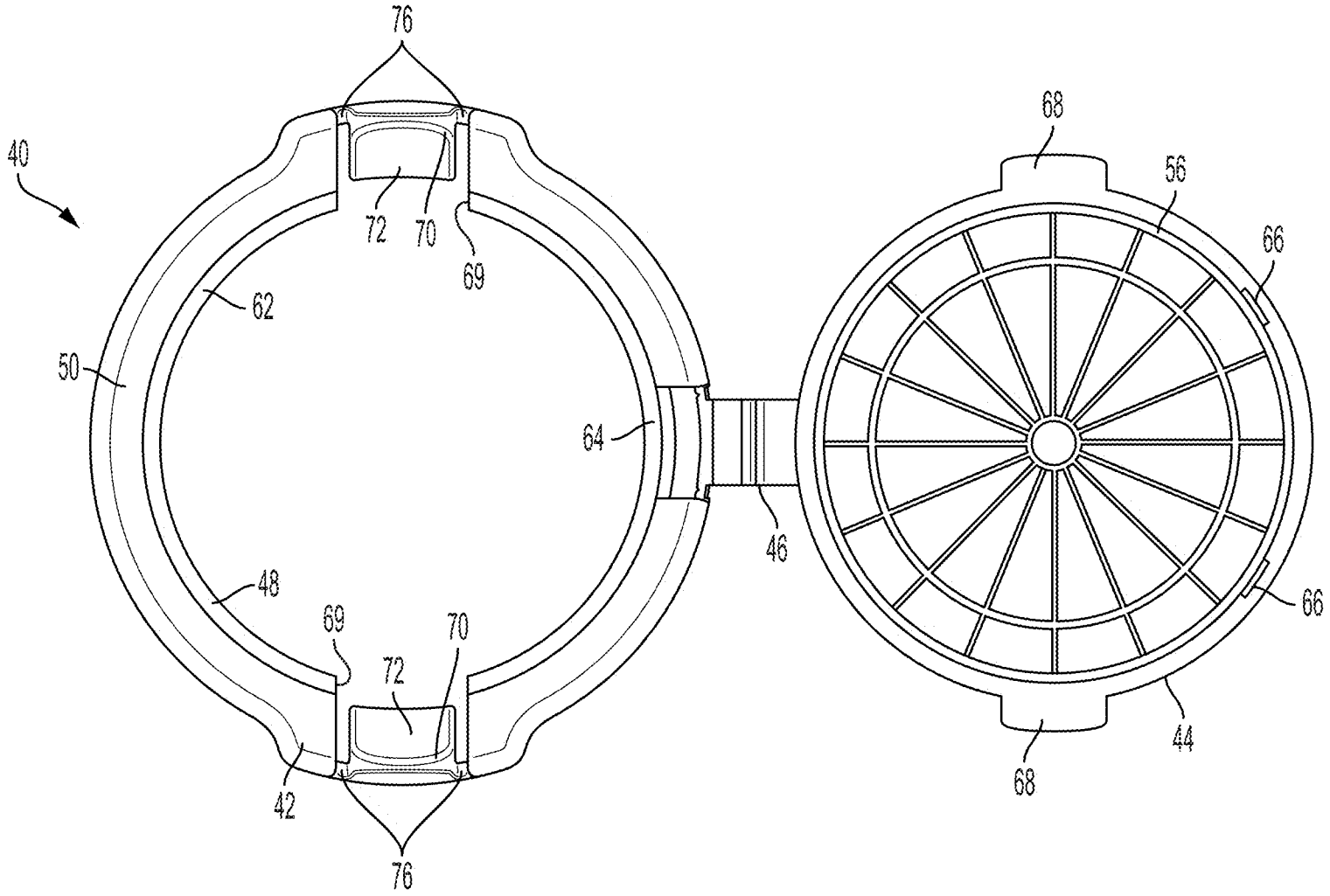
FIG. 7 is a top view of the closure of FIG. 1.
Figure 8:
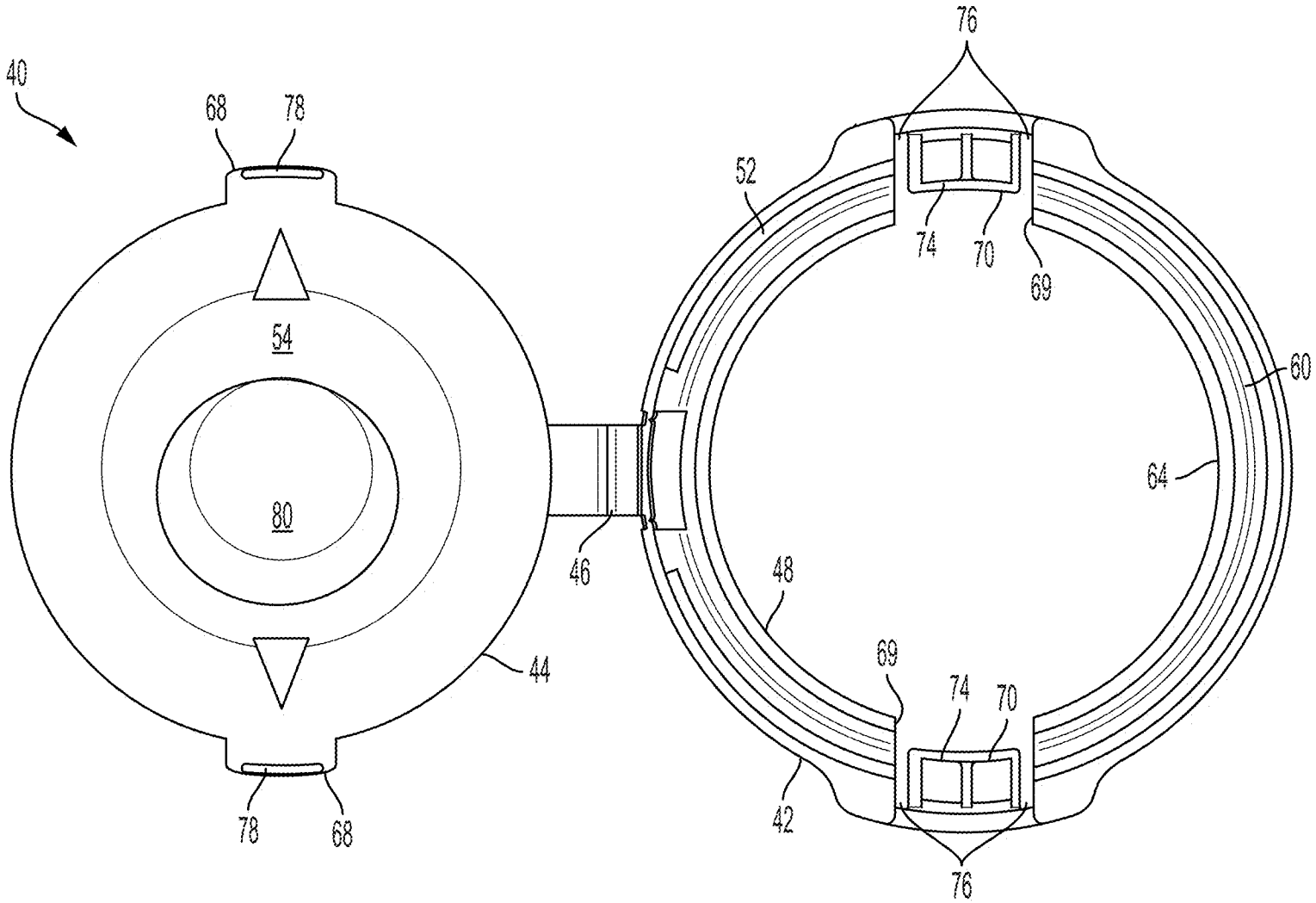
FIG. 8 is a bottom view of the closure of FIG. 1.

In the embodiment of the closure shown in FIGS. 1-8, the base portion 42 may be provided with operating tabs 70. The operating tabs 70 may be diametrically arranged opposite each other on the base portion 42 adjacent the cut-outs 69 and match the lobes 68 on the lid portion 44. Each operating tab 70 may have an actuating portion 72 on an exposed side of the operating tab. The actuating portion 72 may project radially inward to form an engagement portion 74 projecting radially inward from the cut-out 69 and partially across the respective lobe 68 and above or even with the axial height of the recess 62. The operating tabs 70 may be resiliently mounted and/or formed on the base portion so that the operating tabs may be deflected outward by the lobes 68 of the lid portion 44 as the lid portion is pivoted into register with the recess of the base portion 42. Likewise, the operating tabs 70 may be deflected outward by a user to pivot the lobes 68 of the lid portion 44 out of register with the cut-outs 69 and to remove the lid portion from the recess of the base portion 42. In addition, slits 76 may be provided on each side of the operating tab 70 in the cut-outs 69 and extending from the top 50 of the base portion radially inward and axial downward to assist in providing sufficient deflection to engage or disengage from the lid portion 44 with the lid portion in the closed position. Nodules 78 may also be provided on the top 54 of the lid portion to be placed in register with the engagements surfaces 74 of the operating tabs 70 to assist in positively seating the lobes 68 of the lid portion in the recess 62 of the base portion 42. In a neutral position of the operating tabs 70, the engagement portion 74 of the operating tabs engage the tops of the lobes 68 of the lid portion to maintain the lid portion in the recess 62 and over the opening 48. To move the lid portion 44 to the open position relative to the base portion 42, the actuating portion 72 of the operating tabs 70 may be deflected radially outward. In so doing, the engagement portion 74 of the operating tab 74 deflects radially outward to disengage the engagement portion of the operating tab from the tops of the lobes 68 of the lid portion 44, thereby allowing the lid portion to be disengaged from the base portion and to be pivoted via the hinge 46 to the open position, thereby allowing access through the opening to the container. To seal the closure 40, the lid portion 44 may be pivoted relative to the base portion 42 to bring the lobes 68 in register with the cut-outs 69 and the lid portion in register with the recess 62. Doing so, forces the operating tabs 70 outward as the lobes 68 of the lid portion 44 slide on the inclined actuating surface 72 of the operating tabs allowing the engagement portion 74 of the operating tabs 70 to engage the top 54 of the lobes of the lid portion in cut-outs 69 to lock the lid portion with the base portion in the recess 62 over the opening.

Thus, the motion of opening the lid portion 44 via the operating tabs 70 is intuitively opposite of the motion one would believe necessary in order to open the lid portion from the base portion. Ordinarily, one would believe that the actuating portions of the operating tabs 70 must be moved radially inward and toward each other in a pinching-type motion to allow the lid portion 44 to be disengaged from the base portion 42. However, by providing an actuating portion 72 on the radial inward side of the operating tabs 70 and an engagement portion under the actuating portion, the opposite motion may be used to disengage the lid portion from the base portion to allow the lid portion to be pivoted to the open position and allow access to the container. Were the actuating portions of the operating tabs to be deflected radially inward in a pinching type of motion, that would cause the engagement portions of the lid portion to move and be deflected radially inward which would cause the engagement portions to continue to engage the top 54 of the lid portion, thereby preventing the lid portion from being released from the base portion and thereby preventing access to the container. Likewise, once the lid portion 44 is moved to the open position, the tabs may be pulled out to deflect/deform/break the base portion 42 from the container to allow free access to the container.

Figure 9:
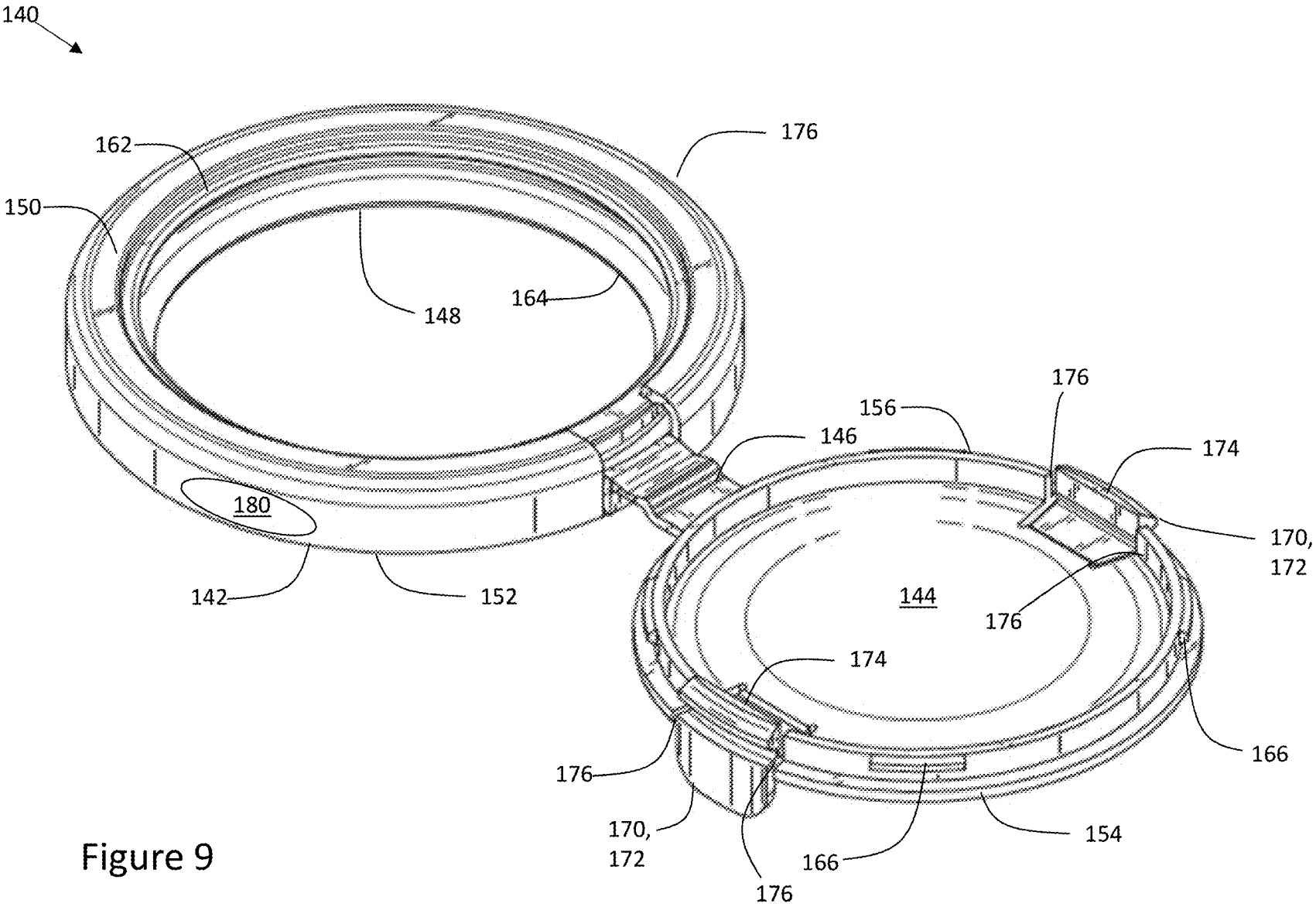
FIG. 9 is a perspective view of another exemplary child safe closure with a lid portion of the closure opened relative to base portion of the closure.
Figure 10:
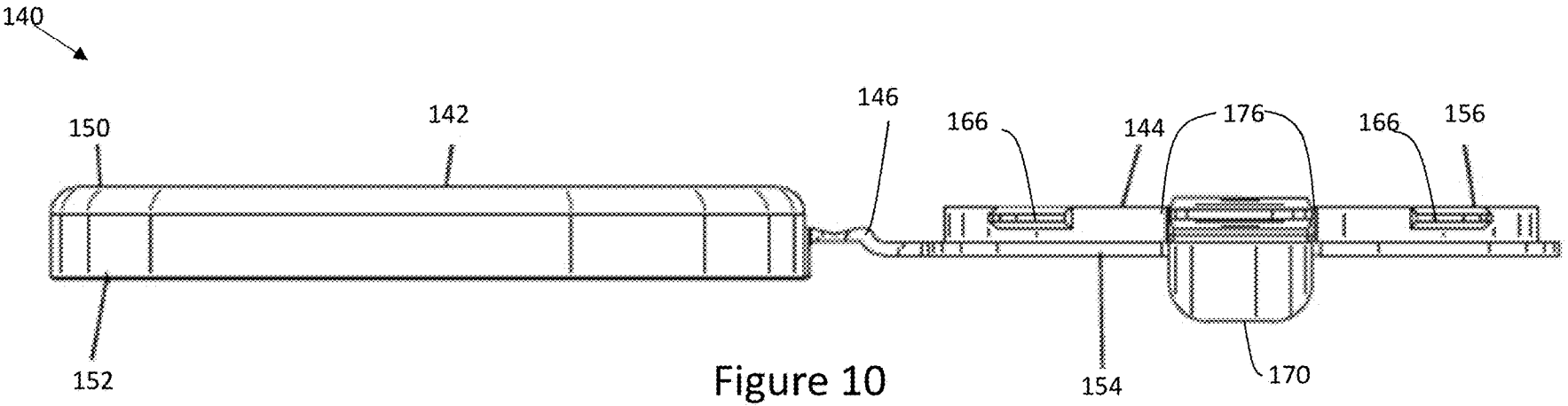
FIG. 10 is a front view of the closure of FIG. 9.
Figure 11:
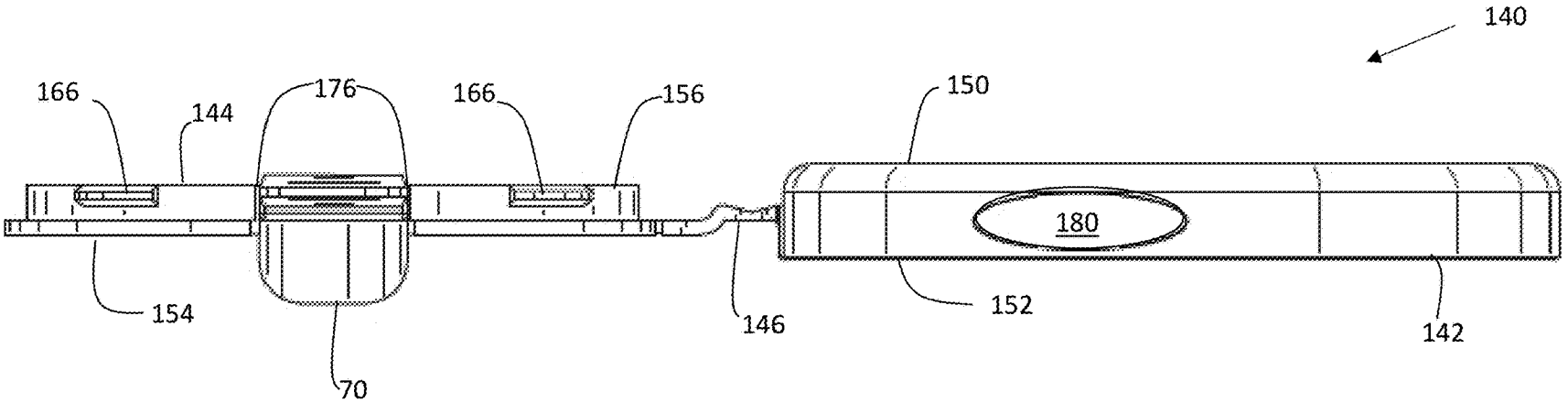
FIG. 11 is a rear view of the closure of FIG. 9.
Figure 12:
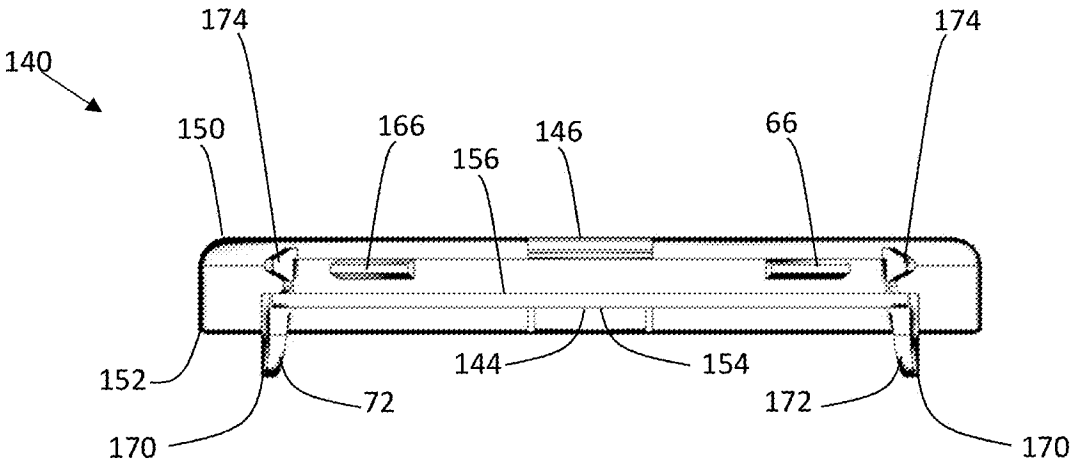
FIG. 12 is a right side view of the closure of FIG. 9.
Figure 13:
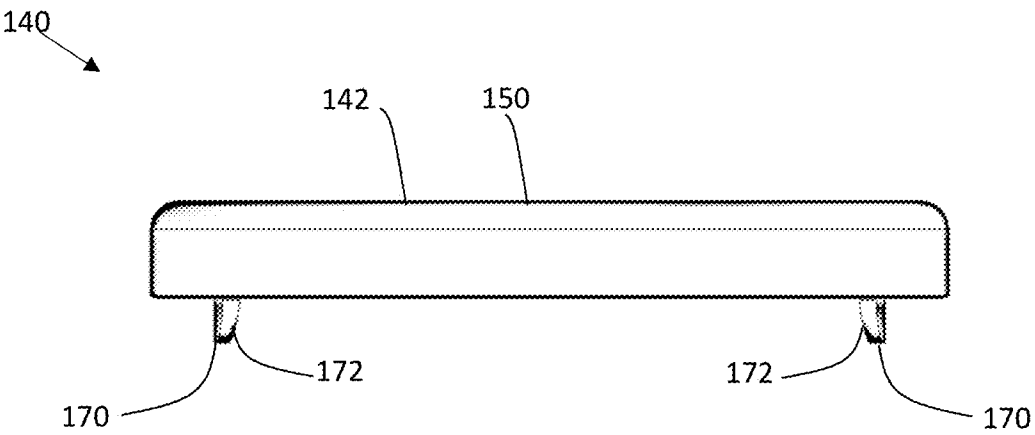
FIG. 13 is a left side view of the closure of FIG. 9.
Figure 14:
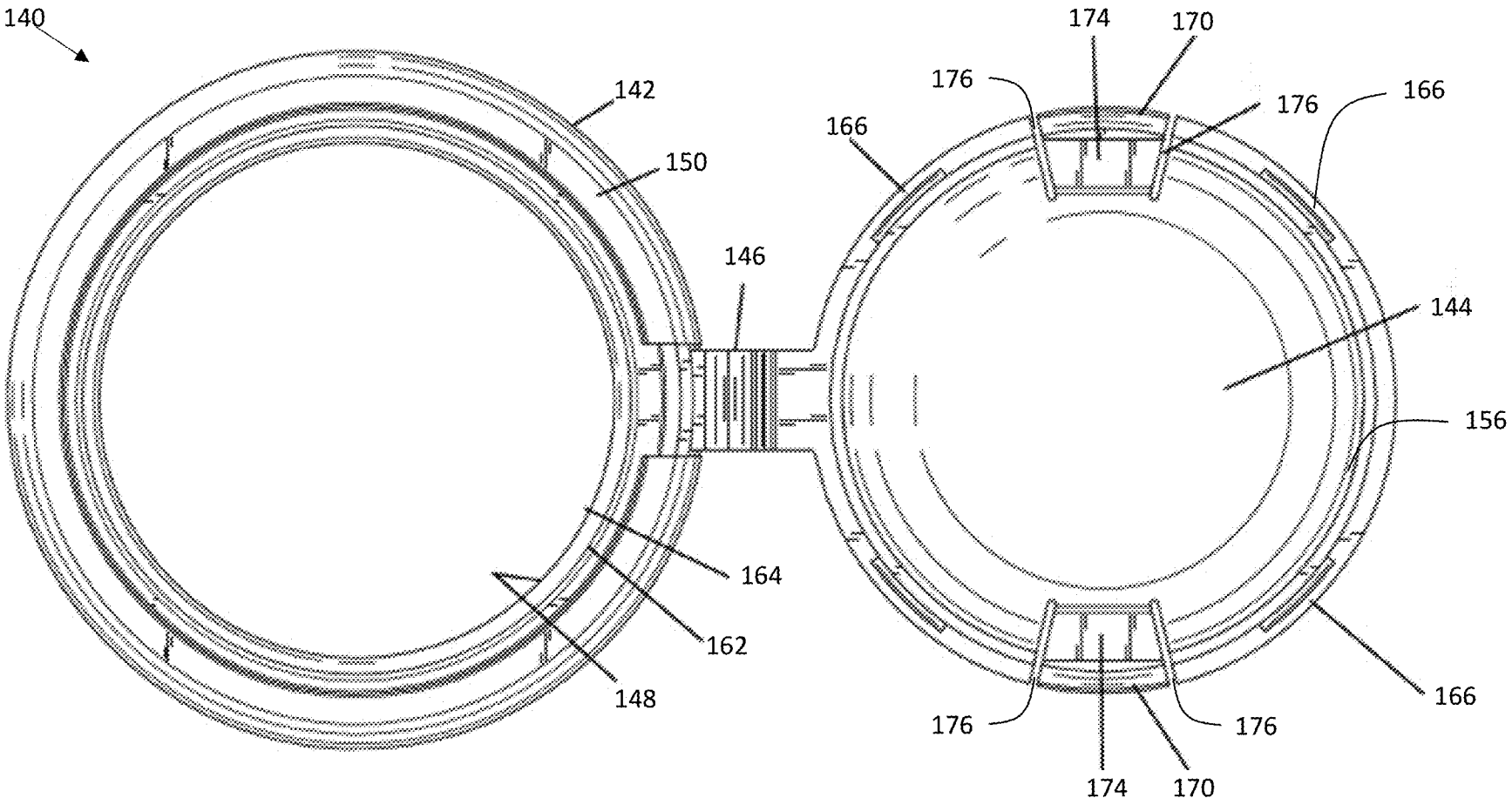
FIG. 14 is a top view of the closure of FIG. 9.
Figure 15:
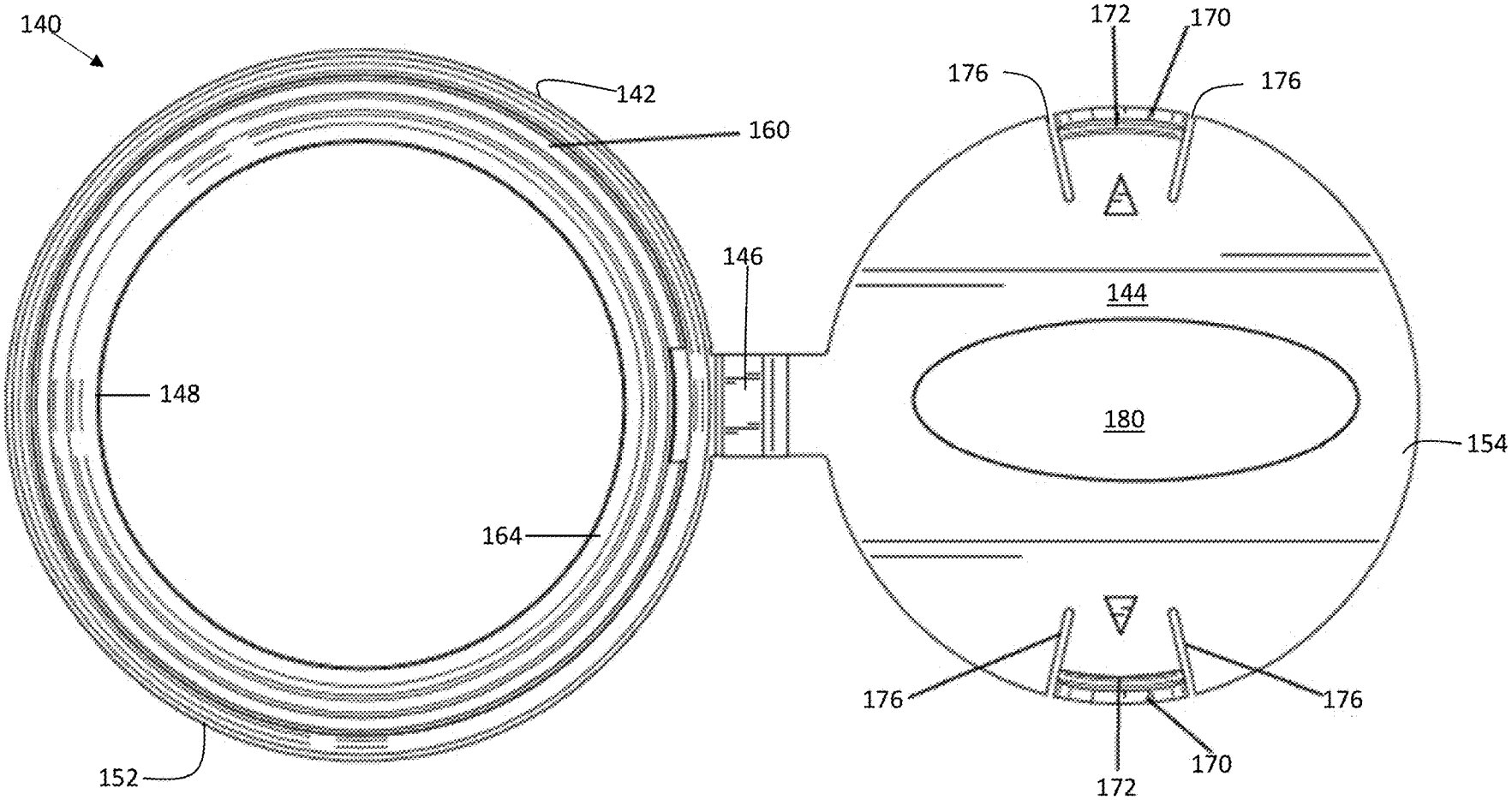
FIG. 15 is a bottom view of the closure of FIG. 9.
Figure 17:
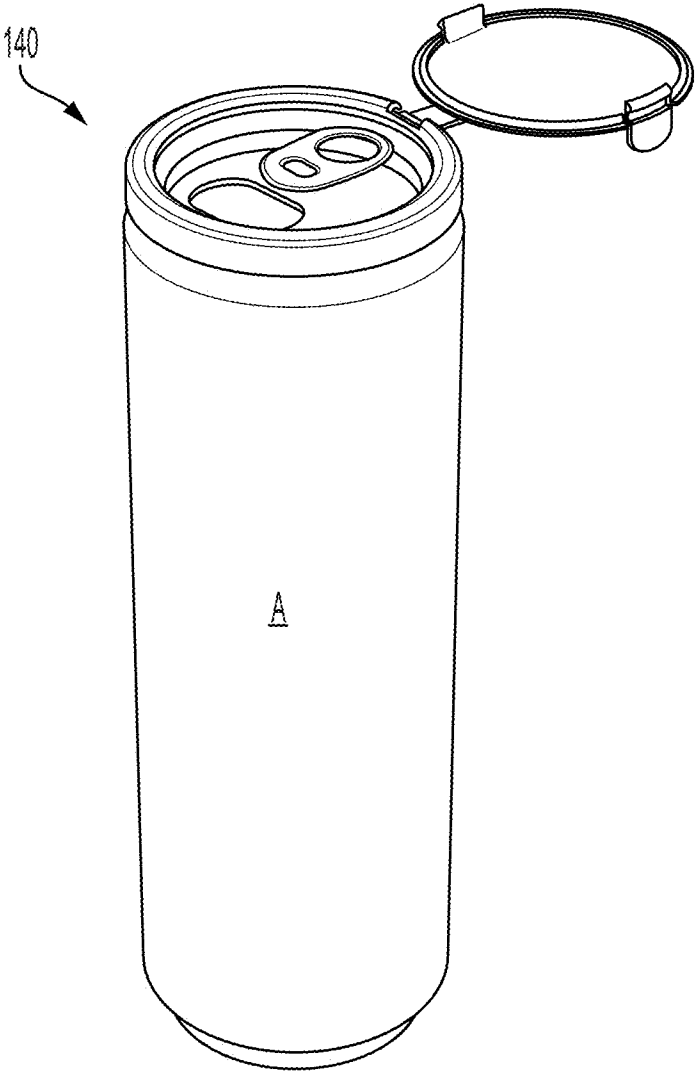
FIG. 17 shows the closure of FIG. 9 is an open position attached to a slim 12 ounce can.
Figure 16:
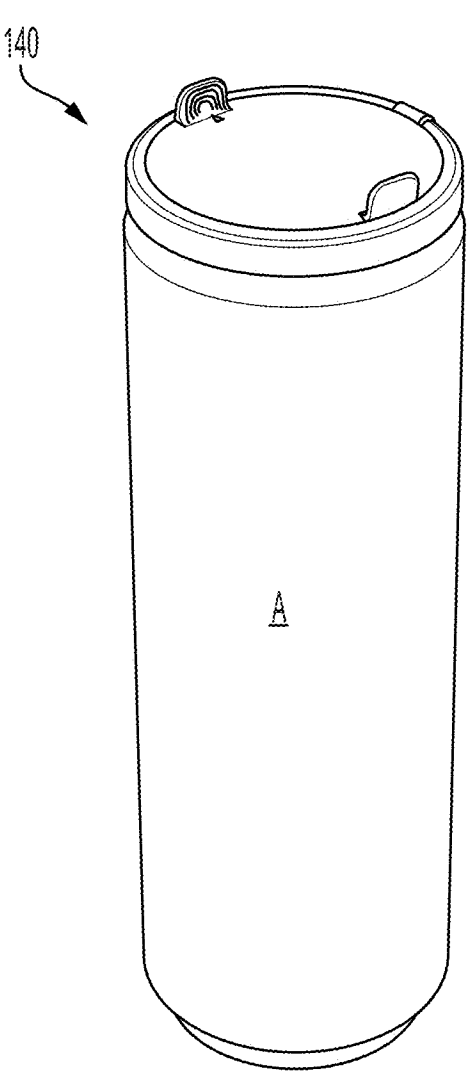
FIG. 16 shows the closure of FIG. 9 is a closed position attached to a slim 12 ounce can.
Figure 19:
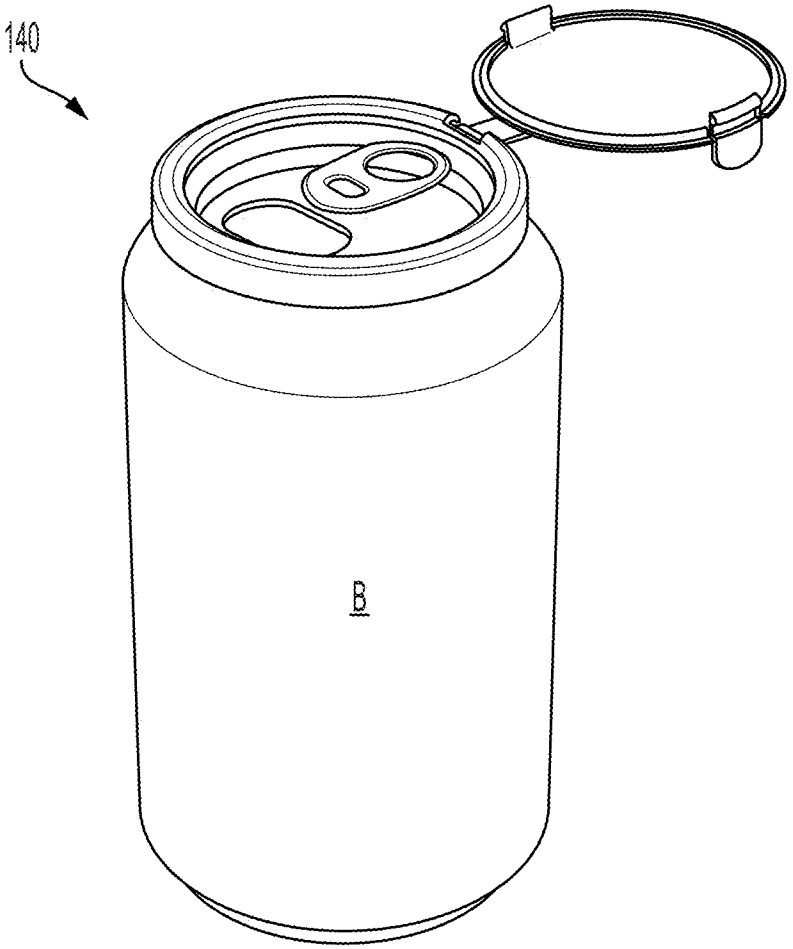
FIG. 19 shows the closure of FIG. 9 is an open position attached to a standard 12 ounce can.
Figure 18:
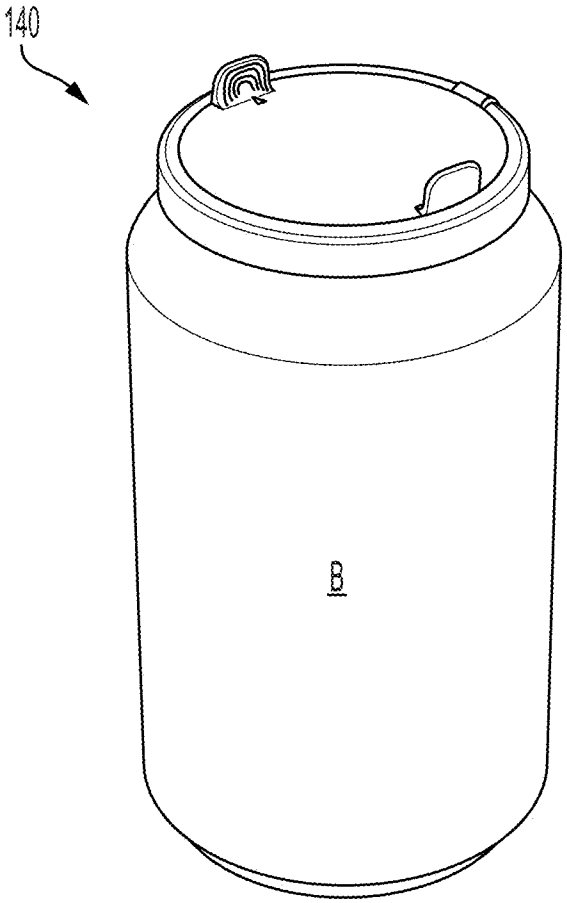
FIG. 18 shows the closure of FIG. 9 is a closed position attached to a standard 12 ounce can.

FIGS. 9-19 show another embodiment of the closure 140 in which the position of the operating tabs 170 is provided on the lid portion 144. The respective elements of the base portion and the lid portion previously described have the same general features and arrangement except as described below and are indicated in the drawings with a prefix of "1", for instance, the closure 140, the base portion 142, the lid portion 144. The operating tabs 170 may be diametrically arranged opposite each other on the lid portion. Each operating tab 170 may have an actuating portion 172 projecting from the top of the lid portion and an engagement portion 174 projecting from the bottom of the lid portion. The operating tabs 170 may be resiliently mounted and/or formed on the lid portion so that the operating tabs may be deflected to engage or disengage from the rim of the base portion. In addition, slits 176 may be provided on each side of the operating tab 170 and extending from the peripheral edge of the lid portion 144 radially inward to assist in providing sufficient deflection to engage or disengage from the rim 162 of the base portion. In a neutral position of the operating tab 170, the engagement portion 174 of the operating tabs 170 engages the rim 164 of the base portion to maintain the lid portion 144 in the recess 162 and over the opening. To move the lid portion 144 to the open position relative to the base portion 142, the actuating portion 172 of the operating tabs 170 may be deflected radially outward. In so doing, the engagement portion 174 of the operating tab 170 deflects radially inward to disengage engagement portion 174 of the operating tab from the rim 164 of the base portion 142, thereby allowing the lid portion to be disengaged from the base portion and to be pivoted via the hinge 146 to the open position, thereby allowing access through the opening 148 to the container. To seal the closure 140, the lid portion 144 may be pivoted relative to the base portion 142 to bring the lid portion in register with the recess 162. Doing so allows the engagement portion 174 of the operating tab 170 to engage the rim 162 in the recess and resiliently deflect around the rim to engage the underside of the rim 162 to lock the lid portion with the base portion in the recess over the opening.

Thus, as before, in the embodiment of FIGS. 9-19, the motion of opening the lid portion with the operating tabs is intuitively opposite of the motion one would believe necessary in order to open the lid. Ordinarily, one would believe that the actuating portions of the operating tabs must be moved radially inward and toward each other in a pinching-type motion to allow the lid portion to be disengaged from the base portion. However, by providing an actuating portion projecting from the top surface of the lid and an engagement portion projecting from the bottom of the lid, the opposite motion may be used to disengage the lid portion from the base portion to allow the lid portion to be pivoted to the open position and allow access to the container. Were the actuating portions of the operating tabs to be deflected radially inward in a pinching type of motion, that would cause the engagement portions on the bottom of the lid portion to move and be deflected radially outward which would cause the engagement portions to continue to engage the rim of the recess, thereby preventing the lid portion from being released from the base portion and thereby preventing access to the container. Likewise, once the lid portion 144 is moved to the open position, the tabs may be pulled out to deflect/deform/break the base portion 142 from the container to allow free access to the container.

The closure may be customizable and contain advertising indicia and other promotional material. For instance, the top and/or bottom of the lid and/or sides of the base may be provided with one or more indicia areas 80,180. In one aspect, a brand owner may utilize the indicia area on the lid to promote a collateral product owned or supplied by the brand owner. In an another aspect, one may direct another to place advertising and promotional material for a third-party in the indicia area. The closure may be provided as part of a kit to enable one to place advertising and promotional material in the indicia area. In this way, one may use or induce another to utilize the closure to provide advertising and promotional materials for others. In one aspect, one may promote a product or service by placing advertising and promotional material for the product in on the indicia area. The product or service promoted may be related to the closure or may be unrelated to the closure. The product or service promoted may refer to the container or contents of the container with which the closure is used. As shown in FIGS. 16-19, the child safe closure may be removably attached to a beverage can, for instance, a slim (200 end diameter) can 'A', a sleek or standard (202 end diameter) can 'B', or a king (206/209/300 end diameter) can (not shown). While FIGS. 16-19 show the closure of FIGS. 9-15 on the respective cans, the closure of FIGS. 1-8 may be likewise removably attached to a beverage can.

As various modifications could be made in the constructions and methods herein described without departing from the scope of the invention, it is intended that all matter contained in the foregoing description and shown in the accompanying drawings shall be interpreted as illustrative and not as limiting. The breath and scope the present invention should not be limited by any of the above described exemplary embodiments.

What is claimed:

1. A closure for a container having a base and a lid, the base being adapted and configured to be attached to the container, the lid being pivotally connected to the base and moveable between an open position in which the lid is spaced from the base to provide access to an opening formed in the base, and a closed position in which the lid abuts the base and extends over the opening formed in the base to block access to the opening, one of the lid and the base having first and second operating tabs on a periphery of the respective one of the lid and the base, each operating tab having an actuation portion and an engagement portion, the engagement portion being moveable between an engagement position and a disengagement position, wherein when the lid is in the closed positioned, the engagement portion is configured to engage the other of the lid and the base in the engagement position, wherein when the lid is in the closed position, the engagement portion is configured to disengage from the other of the lid and the base in the disengagement position, the actuation portion of the operating tab being configured to be resiliently deflectable radially outward relative to the respective one of the lid and the base to move the engagement portion to the disengagement position whereupon release of the actuation portion, the engagement portion returns to the engagement position.

2. The closure of claim 1 wherein the operating tabs are disposed on the lid.

3. The closure of claim 2 wherein the operating tabs extend from a top of the lid and the engagement portion extends from a bottom of the lid.

4. The closure of claim 3 wherein the engagement portion moves radially inward when moving to the disengagement position.

5. The closure of claim 3 wherein the base has a recess adapted and configured to receive the lid when the lid is in the closed position relative to the base.

6. The closure of claim 5 wherein the base has a rim formed in the recess.

7. The closure of claim 6 wherein the engagement portion engages the rim in the engagement position.

8. The closure of claim 1 wherein at least one of the base and the lid has an indicia area for promotional material.

9. The closure of claim 1 wherein the operating tabs are diametrically opposite each other on an outer periphery of the respective one of the lid and the base.

10. The closure of claim 1 wherein the lid and the base are monolithically formed.

11. The closure of claim 1 wherein the base has an internal groove that is dimensioned to receive a portion of the container in attaching the closure to the container.

12. The closure of claim 11 wherein the groove is configured to engage a beverage container having one of a class 200 end diameter, a class 202 end diameter, and a class 206/209/300 end diameter.

13. The closure of claim 1 wherein the lid is pivotally connected to the base with a hinge.

14. The closure of claim 13 wherein the lid, the base, and the hinge are monolithically formed.

15. The closure of claim 1 wherein the operating tabs are disposed on the base.

16. The closure of claim 15 wherein the engagement portion moves radially outward when moving to the disengagement position.

17. The closure of claim 15 wherein the base has a recess adapted and configured to receive the lid when the lid is in the closed position relative to the base.

18. The closure of claim 17 wherein the engagement portion engages an exposed surface of the lid when the lid is positioned in the recess of the base.

19. The closure of claim 18 wherein the base has a rim formed in the recess adapted to support the lid when the lid is in the closed position relative to the base.

* * * * *